US006135383A

United States Patent [19]

Flamm et al.

[11] Patent Number: 6,135,383

[45] Date of Patent: Oct. 24, 2000

[54] DEVICE FOR CONTROLLING THE CREEL OF A TEXTILE MACHINE

[75] Inventors: Franz-Josef Flamm, Stolberg; Christian Sturm, Krefeld, both of Germany

[73] Assignee: W. Schlafhorst AG & Co., Germany

[21] Appl. No.: 09/293,377

[22] Filed: Apr. 16, 1999

[30] Foreign Application Priority Data

Apr. 18, 1998 [DE] Germany ..... 198 17 363

[51] Int. Cl.[7] ..... B65H 54/54

[52] U.S. Cl. ..... 242/486.2; 242/477.4

[58] Field of Search ..... 242/477, 476.9, 242/477.4, 481.9, 486.2, 486.4, 477.7, 486.8

[56] References Cited

U.S. PATENT DOCUMENTS

| | | | |
|---|---|---|---|
| 3,291,407 | 12/1966 | Tata | 242/486.2 X |
| 3,948,453 | 4/1976 | Abbott | 242/486.4 X |
| 3,991,950 | 11/1976 | Tashiro et al. | 242/486.4 |
| 5,112,000 | 5/1992 | Derichs et al. | 242/486.4 |
| 5,163,631 | 11/1992 | Borer | 242/486.4 |
| 5,409,173 | 4/1995 | Fahmuller et al. | 242/486.2 X |
| 5,639,036 | 6/1997 | Flamm | 242/486.2 |
| 5,697,565 | 12/1997 | Zitzen | 242/486.4 |

FOREIGN PATENT DOCUMENTS

| | | |
|---|---|---|
| 0 351 672 A1 | 7/1989 | European Pat. Off. . |
| 1 083 718 | 6/1960 | Germany . |
| 39 27 142 A1 | 2/1991 | Germany . |
| 295 20 857 U1 | 5/1996 | Germany . |
| 195 27 214 A1 | 1/1997 | Germany . |
| 195 34 333 A1 | 3/1997 | Germany . |
| 1-294172 | 11/1989 | Japan . |
| WO 99/41180 | 8/1999 | WIPO . |

*Primary Examiner*—Donald P. Walsh
*Assistant Examiner*—Collin A. Webb
*Attorney, Agent, or Firm*—Kennedy Covington Lobdell & Hickman

[57] ABSTRACT

A device for controlling the creel (10) of a textile machine, which creel is pivotably seated by means of a pivot shaft to support a bobbin in frictional driven contact with a drive roller, is connected with a drive element for generating torque, e.g., a stepper motor or other device displaceable in angular steps or increments. A torque transducer is arranged between the creel and the drive element to convert the displacement of the drive element into a defined torque acting on the creel.

20 Claims, 1 Drawing Sheet

DEVICE FOR CONTROLLING THE CREEL OF A TEXTILE MACHINE

FIELD OF THE INVENTION

The present invention relates generally to a device for controlling a creel of a textile machine and more particularly to such a device for controlling a creel which receives a bobbin friction driven by a drive roller, is pivotably seated by means of a pivot shaft and is connected with means for generating a torque.

BACKGROUND OF THE INVENTION

It is intended by means of a device of the above- mentioned type to control the contact pressure between a bobbin maintained in a creel and a roller, which drives the bobbin by friction, so as to follow a course matched to the building of the bobbin.

Such a device is known, for example, from German Patent Publications DE 39 27 142 A1 or DE 195 27 214 A1. With the device in accordance with German Patent Publication DE 39 27 141 A1, the means for generating a torque include an electric motor, whose driving force is transmitted to the creel in the form of a torque by means of a toothed belt drive and rods.

In a device known from German Patent Publication DE 195 27 214 A1, an electric motor generates a torque, which is transmitted to the pivot shaft, and thus to the creel, by means of a belt drive. The belt drive contains one or two belts wound around the driveshaft of the electric motor, which are fastened to the drive shaft and at two fastening points of a transfer lever, which is connected, fixed against relative rotation, with the pivot shaft of the creel. Such a belt drive transmits a torque in a manner almost free of play and hysteresis. Both known devices require an electric motor, whose power or torque is proportional to the current strength applied to it.

SUMMARY OF THE INVENTION

As a technical problem, it is therefore an object of the invention to provide a device of the type mentioned above, which can be produced in a cost-effective manner.

This object is attained in accordance with the present by providing the control device with a torque transducer arranged between the creel and a drive element, which can be displaced by predeterminable steps, to convert the displacement of the drive element into a defined torque acting on the creel.

Such a device can be simply constructed, because only the stepwise displaceable position of the drive element needs to be controlled for charging the pivotable creel with a defined torque. The drive element need not provide an exactly defined force, but must merely have the property of being displaceable into predetermined positions.

In accordance with the present invention, it is provided that the stepwise displaceable drive element is constituted by a drive element which can be displaced by predeterminable angular steps. In this manner, the simple transmitting ability of rotary movements can be utilized.

In accordance with a further development of the invention, it is provided that the stepwise angularly displaceable drive element is designed as a stepper motor. A precise and cost-effective electrical displacement device for the torque transducer is provided in this manner, because stepper motors are produced in large numbers and perform a rotation in predeterminable angle steps.

A further feature of the invention provides that the torque transducer comprises a first element, which is fixedly connected against relative rotation with the pivot shaft, and a second element, which is rotatable in relation to the first element and is driven by the drive element, and provides further that resilient transmission elements are arranged between the first element and the second element. The transmission of a defined torque to the creel, which is largely free of play and hysteresis, is thereby made possible.

Further characteristics and advantages of the invention will be described and understood from the following description of the exemplary embodiment represented in the accompanying drawings.

DETAILED DESCRIPTION OF THE PREFERRED EMBODIMENT

Figure 1:
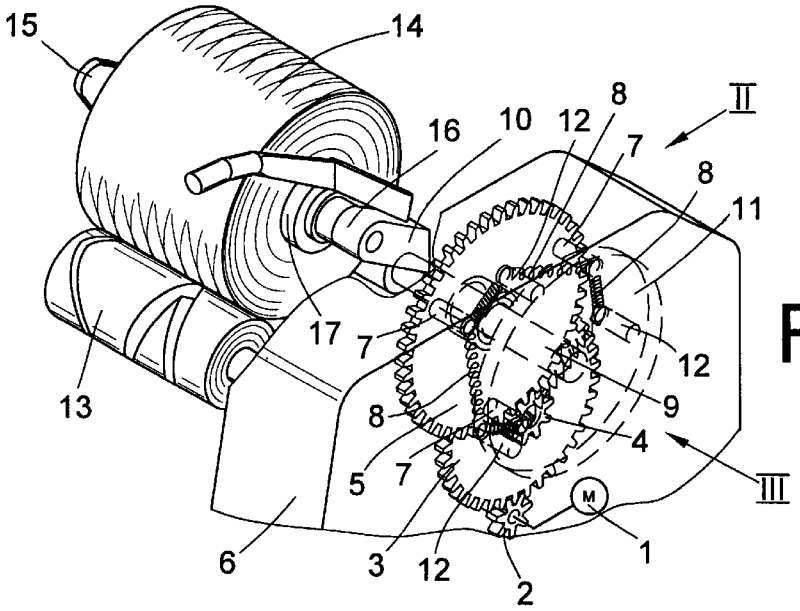
FIG. 1 is a partial perspective view of a winding station of a textile machine equipped with a creel and a control device in accordance with a preferred embodiment of the present invention.
Figure 2:
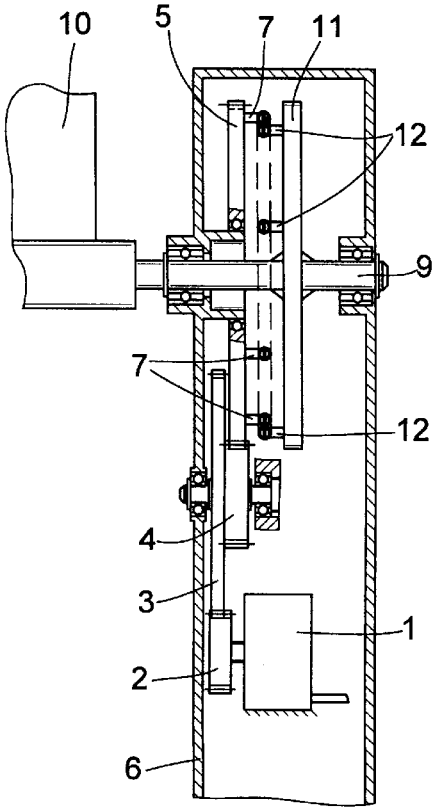
FIG. 2 is a partially sectioned elevational view of the winding station of FIG. 1 as viewed in the direction of the arrow II.
Figure 3:
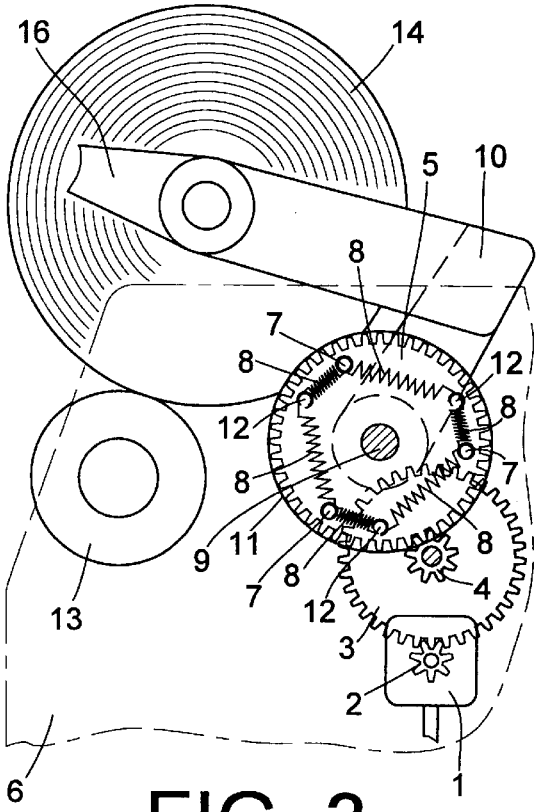
FIG. 3 is another partially sectioned elevational view of the winding station of FIG. 1 as viewed in the direction of the arrow III.

Referring now to the accompanying drawings and initially to FIG. 1, a representative embodiment of the control device of the present invention is shown as incorporated in a winding station of a bobbin winding machine which basically includes yarn guide drum 13 seated in a machine housing 6. The yarn guide drum 13 drives a cheese 14 which is held by means of a creel 10 to rest in frictional contact against the peripheral surface of the drum 13. The creel 10 is pivotably seated by means of a pivot shaft 9 which is arranged on the machine housing 6 parallel with the shaft of the yarn guide drum 13, and is fixedly connected with this pivot shaft 9 against relative rotation. The drive torque generated for the cheese 14 by the yarn guide drum 13 is a function of the frictional effect resulting from the contact pressure with which the cheese 14 rests on the yarn guide drum 13. This contact pressure can be increased or decreased by means of the application of a torque to the creel 10.

The creel 10 has two bobbin arms 15, 16, which are provided with rotatably seated cone plates 17. A bobbin tube is clamped between the cone plates 17 of the bobbin arms 15, 16, on which bobbin a yarn is wound for creating the cheese 14. The bobbin arm 16, along with its cone plate 17, can be pivoted laterally away from the cheese 14 in a manner not shown in detail, so that a full cheese 14 can be removed from the creel 10, and an empty bobbin tube can be inserted.

A torque transducer is attached to the pivot shaft 9 of the creel 10. This torque transducer includes a connecting plate 11 fixed with the pivot shaft 9 against relative rotation and a gear wheel 5 rotatably seated coaxially with the pivot shaft 9. The connecting plate 11 is provided with the connecting bolts 12 located equidistantly from the pivot shaft 9 and from one another so as to define the apexes of an equilateral triangle. The connecting bolts 12 extend toward the gear wheel 5. Connecting bolts 7 are also provided on the gear wheel 5 in an equilateral triangular relation spaced equidistant from the pivot shaft 9 and one another correspondingly to the equilateral triangle formed by the three connecting bolts 12 on the connecting plate 11. Identical spring elements 8, preferably in the form of helical springs, are attached consecutively between the connecting bolts 12 of the connecting disk 11 and the connecting bolts 7 of the gear wheel 5, whereby the relative turning of the gear wheel and the connecting disk 11 causes the alternating and intervening springs to be deformed in opposite directions to one another. These spring elements 8 are advantageously pre-stressed.

The gear wheel 5 meshes with a pinion 4 of a reduction gear whose outer rim 3 is driven via a drive pinion 2 by means of a stepper motor 1. This reduction gear reduces one revolution of the stepper motor 1 at a ratio of, for example, 1 to 25, and transmits such motion to the gear wheel 5. The drive pinion 2, the outer rim 3 and the pinion 4 are rotatably seated on the winding station housing 6. The stepper motor 1 is also fixed in place on this winding station housing 6. This stepper motor 1 is designed for individual angular steps of approximately 1.8 degrees. The stepper motor 1 is controlled by a computer, not represented in the drawings, by means of an electronic unit, also not represented, and is thus enabled to perform a defined number of revolutions, defined rpm or a defined number of individual steps.

The consecutive spring elements 8, which are connected between the connecting bolts 7, 12, are stressed or released in accordance with the direction of the turning of the gear wheel 5, which results in forces which act on the contact bolt 12 of the connecting disk 11 in the direction of turning of the gear wheel 5 and which are located in the plane of the connecting disk 11. The components of these forces oriented tangentially to the pivot shaft 9 act in this way on the connecting disk 11 and therefore on the creel 10 with a torque around the pivot shaft 9. By pre-stressing the spring elements 8 it is achieved that a turning of the gear wheel 5 is converted into a torque as free of play as possible.

Because this torque causes the contact pressure between the cheese 14 and the yarn guide drum 13 to be increased or decreased, it is possible to adjust this contact pressure by a defined number of angular steps of the gear wheel 5 in respect to the connecting disk 11 by means of the stepper motor 1, without the force with which the gear wheel 5 is turned having an effect.

It is possible by means of a defined setting of the contact pressure between the cheese 14 and the yarn guide drum 13, such as is extensively described in German Patent Publication DE 39 27 142 A1, to prevent the appearance of pattern windings on the cheese 14 by changing the number of revolutions of the cheese 14 in relation to the number of revolutions of the yarn guide drum 13.

Pattern windings are created if, with a slip-free drive, the number of revolutions of the yarn guide drum 13 is approximately a whole number multiple of the number of revolutions of the cheese 14. These pattern windings can be suppressed by briefly inducing a defined slippage between the cheese 14 and the yarn guide drum 13. By reducing the contact pressure, the drive torque transmitted by friction from the yarn guide drum 13 to the cheese 14 is reduced and therefore the number of revolutions of the cheese 14 is reduced because of air friction, bearing friction and yarn moment. If required, the cheese 14 can additionally be slightly braked by means of a pneumatic bobbin brake to aid this. A bobbin brake suitable for this purpose is described, for example, in German Patent Publication DE 196 50 932.7 or in the manual "Autoconer" by W. Schlafhorst & Co. AG on page 1.3.8.

Pattern windings in the course of winding are prevented by the device in accordance with the invention in that the gear wheel 5 is turned by means of the stepper motor 1 into a position which corresponds to the desired contact pressure of the cheese 14 on the yarn guide drum 13. The control of the contact pressure as a function of the bobbin travel by adjusting the stepper motor 1 is performed by means of a computer using a control program. Such a control program calculates the required position of the stepper motor 1, expressed in positive or negative steps, for example on the basis of sensor data which are supplied to it during the entire bobbin travel. As a function thereof, the control program causes a turning of the stepper motor 1.

The sensor data can be data, for example, which is obtained from rpm sensors assigned to the yarn guide drum 13 and the cheese 14 for measuring the number of revolutions. The sensor data furthermore can be represented by data which stem from the detection of the bobbin travel by means of suitable sensors, or from determining the thickness of the cheese 14, perhaps by means of a method disclosed in German Patent Publication DE 196 25 512 A1.

By turning the stepper motor 1 at the end of the bobbin travel, the full cheese 14 is pivoted away from the yarn guide drum 13 into a position in which it is possible to remove the full cheese 14 from the creel 10 and to insert an empty tube, e.g., possibly by using an automatic device.

However, it is also conceivable to pivot the full cheese 14 away from the yarn guide drum 13 at the end of a bobbin travel by hydraulic or pneumatic means for a tube exchange. With such a design a controllable coupling is then provided in the pivot shaft 9 if required. During the bobbin travel the torque transducer is fixedly coupled to the creel 10 by means of this coupling. This connection is released at the end of the bobbin travel, so that the creel is freely rotatable on the pivot shaft and can then be pivoted away hydraulically or pneumatically.

In order to additionally suppress oscillations of the creel 10 during the entire bobbin travel, damping cylinders acting on the bobbin arms 15 and 16 can be provided.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile machine for selective winding of a bobbin, comprising:

(a) a creel attached to a pivot shaft for pivoting of the bobbin into frictional surface driven contact with a drive roller, (b) a drive member , and (c) a torque transducer arranged between the pivot shaft and the drive member for converting displacement by the drive member into torque acting on the creel, the torque transducer including, (i) a first element fixed against rotation relative to said pivot shaft, (ii) a second element rotatably disposed relative to said pivot shaft, said second element being driven by said drive element, and (iii) a transmission element having portions respectively connected to said first element and said second element, said transmission element being resilient along an axis thereof extending between said portions connected to said first and second elements.

2. The device in accordance with claim 1, wherein the drive element comprises a stepper motor.

3. The device in accordance with claim 1, wherein said torque transducer includes a reduction gear arranged between said second element and said drive element.

4. The device in accordance with claim 1, wherein said first element and said second element are arranged coaxially with respect to each other and are rotatable in relation to each other.

5. The device in accordance with claim 1, wherein said resilient transmission element comprises a helical spring.

6. The device in accordance with claim 5, wherein said second element is coaxial with said pivot shaft and said helical spring is oriented essentially tangentially in relation to said pivot shaft.

7. The device in accordance with claim 6, further comprising additional said resilient transmission elements, and wherein all said resilient transmission elements are essentially arranged equidistantly from said pivot shaft.

8. The device in accordance with claim 1, further comprising additional said resilient transmission elements, and wherein all said resilient transmission elements are consecutively arranged between said first element and said second element to be stressed in opposite directions when said second element is rotated relative to said first element.

9. The device in accordance with claim 1, wherein said resilient transmission element is pre-tensioned.

10. A textile machine for selective winding of a bobbin, comprising, (a) a creel attached to a pivot shaft for pivoting of the bobbin into frictional surface driven contact with a drive roller, (b) a drive member, and (c) a torque transducer arranged between said pivot shaft and said drive member for converting displacement by said drive member into torque acting on said creel, said torque transducer including, (i) a first element fixed against rotation relative to said pivot shaft, (ii) a second element rotatably disposed relative to said pivot shaft, said second element being driven by said drive element, (iii) a resilient transmission element connecting said first element with said second element, and (iv) a reduction gear arranged between said second element and said drive member.

11. The device in accordance with claim 10, further comprising additional said resilient transmission elements, and wherein all said resilient transmission elements are consecutively arranged between and connected to said first element and said second element to be stressed in opposite directions when said second element is rotated relative to said first element.

12. The device in accordance with claim 11, wherein said second element is coaxial with said pivot shaft and all said resilient transmission elements are essentially arranged equidistantly from said pivot shaft.

13. A textile machine for selective winding of a bobbin, comprising, (a) a creel attached to a pivot shaft for pivoting of the bobbin into frictional surface driven contact with a drive roller, (b) a drive member, and (c) a torque transducer arranged between said pivot shaft and said drive member for converting displacement by said drive member into torque acting on said creel, said torque transducer including, (i) a first element fixed against rotation relative to said pivot shaft, (ii) a second element rotatably disposed relative to and in coaxial relation with said pivot shaft, said second element being driven by said drive element, and (iii) a resilient transmission element connecting said first element with said second element.

14. The device in accordance with claim 13, further comprising additional said resilient transmission elements, and wherein all said resilient transmission elements are consecutively arranged between and connected to said first element and said second element to be stressed in opposite directions when said second element is rotated relative to said first element.

15. The device in accordance with claim 14, wherein all said resilient transmission elements are essentially arranged equidistantly from said pivot shaft.

16. A textile machine for selective winding of a bobbin, comprising, (a) a creel attached to a pivot shaft for pivoting of the bobbin into frictional surface driven contact with a drive roller, (b) a drive member, and (c) a torque transducer arranged between said pivot shaft and said drive member for converting displacement by said drive member into torque acting on said creel, said torque transducer including, (i) a first element fixed against rotation relative to said pivot shaft, (ii) a second element rotatably disposed relative to said pivot shaft, said second element being driven by said drive element, and (iii) a resilient transmission element connecting said first element with said second element, said resilient transmission element comprising a helical spring.

17. The device in accordance with claim 16, further comprising additional said helical springs, and wherein all said helical springs are consecutively arranged between and connected to said first element and said second element to be stressed in opposite directions when said second element is rotated relative to said first element.

18. The device in accordance with claim 17, wherein said second element is coaxial with said pivot shaft and all said helical springs are essentially arranged equidistantly from said pivot shaft.

19. A textile machine for selective winding of a bobbin, comprising, (a) a creel attached to a pivot shaft for pivoting of the bobbin into frictional surface driven contact with a drive roller, (b) a drive member, and (c) a torque transducer arranged between said pivot shaft and said drive member for converting displacement by said drive member into torque acting on said creel, said torque transducer including, (i) a first element fixed against rotation relative to said pivot shaft, (ii) a second element rotatably disposed relative to said pivot shaft, said second element being driven by said drive element, and (iii) resilient transmission elements connecting said first element with said second, said resilient transmission elements being consecutively arranged between said first element and said second element to be stressed in opposite directions when said second element is rotated relative to said first element.

20. The device in accordance with claim 19, wherein said second element is coaxial with said pivot shaft and all said helical springs are essentially arranged equidistantly from said pivot shaft.

* * * * *